US006595750B2

(12) United States Patent
Parneix et al.

(10) Patent No.: US 6,595,750 B2
(45) Date of Patent: Jul. 22, 2003

(54) COMPONENT OF A FLOW MACHINE

(75) Inventors: Sacha Parneix, Zurich (CH); Martin Schnieder, Ennetbaden (CH); Jens von Wolfersdorf, Holzgerlingen (DE)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 10/013,666

(22) Filed: Dec. 13, 2001

(65) Prior Publication Data

US 2002/0176776 A1 Nov. 28, 2002

(30) Foreign Application Priority Data

Dec. 16, 2000 (DE) ..... 100 62 906
May 30, 2001 (DE) ..... 101 26 215

(51) Int. Cl.[7] ..... F01D 5/18
(52) U.S. Cl. ..... 416/97 R
(58) Field of Search ..... 415/115; 416/97 R

(56) References Cited

U.S. PATENT DOCUMENTS 4,474,532 A * 10/1984 Pazder ..... 416/97 R
4,604,031 A * 8/1986 Moss et al. ..... 416/97 R
5,073,086 A 12/1991 Cooper
5,498,126 A 3/1996 Pighetti et al.
6,347,923 B1 * 2/2002 Semmler et al. ..... 416/97 R

FOREIGN PATENT DOCUMENTS

EP 0672821 A1 9/1995
EP 0816636 A1 1/1998

OTHER PUBLICATIONS

NASA CR 1656087, Thulin et al. 1982.

* cited by examiner

*Primary Examiner*—Ninh H. Nguyen
(74) *Attorney, Agent, or Firm*—Burns, Doane, Swecker & Mathis, L.L.P.

(57) ABSTRACT

The present invention relates to a component of a flow machine, particularly a turbine blade, which has a cooling channel (9, 10) through which cooling medium can flow, with at least one deflection (5) formed by the wall (11, 12) of the cooling channel, by means of which deflection the flow of the cooling medium from a first channel section (9) is deflected into a second channel section (10) situated downstream. At least one flow guiding element (8) is arranged in the cooling channel in the region of the deflection, and divides the cooling channel into an inner (13) and an outer (14) flow channel. In the present component, the inner flow channel (13) has a constriction in the flow cross section. By the proposed configuration of the cooling channel deflection, the pressure loss brought about by the deflection is minimized and simultaneously a distinctly more homogeneous heat transfer is attained to the cooling medium, without local temperature peaks.

11 Claims, 4 Drawing Sheets

COMPONENT OF A FLOW MACHINE

FIELD OF THE INVENTION

The present invention relates to a component of a flow machine, particularly a turbine blade, which has a cooling channel through which a cooling medium can flow and which has at least one deflection formed by the wall of the cooling channel and deflecting the flow of the cooling medium from a first channel section into a downstream second channel section, wherein at least one flow guiding element, by which the cooling channel is divided in the deflection into an inner and an outer flow channel, is arranged in the cooling channel in the region of the deflection.

In the field of flow machines, particularly gas turbines, increasingly higher temperatures are sought and put into practice for increasing the power output. The higher temperatures are attained on the one hand by advances in materials technology toward higher permissible material temperatures, and on the other hand by improved cooling of the components which are exposed to the high temperatures. Precisely in the gas turbine field, the necessity exist here to further improve the cooling for new generations of gas turbine blades.

A known cooling method for the cooling of gas turbine blades is internal, convective cooling. In this cooling method, cooling air is introduced through the rotor shaft into the blade foot and from there into cooling channels running within the turbine blade, in which it takes up the heat of the turbine blade. The heated cooling air is finally blown out of the turbine blade through suitably arranged bores and slits.

An exemplary course of the cooling air channels in a gas turbine blade (according to Thalin et al., 1982: NASA CR 1656087) is shown in FIG. 1. The cooling air enters the turbine blade via the blade foot 1, is conducted via a cooling channel 2 as far as the rear side of the blade, and is finally blown out through corresponding aperture slits 3. In the example shown in FIG. 1, a separate cooling channel 2*a* is additionally provided, via which a portion of the cooling air is conducted to the front side and tip of the blade, to emerge there via corresponding apertures 4. The flow course of the cooling air within the turbine blade is indicated by the arrows.

In a typical course of the cooling air channel, 180° deflections 5 are required in the neighborhood of the blade tip or blade foot, to connect together the different sections of the cooling air channel 2. However, complicated flow patterns develop in the region of this deflection 5, with eddies which lead to large pressure losses over the length of the cooling air channel 2 and thus require an increased pump power for the transport of the cooling air. Furthermore, areas of low heat transfer to the turbine blade arise in these regions and lead to local temperature peaks on the outer skin of the turbine blade.

FIG. 2 shows schematically a detail of a cooling air channel 2 with a deflection 5, in which the recirculation areas, i.e., the areas which generate the high pressure losses, are denoted by the reference numeral 6. The flow course of the cooling medium is again shown by the arrows. Besides the pressure loss, the recirculation areas have only a small throughflow, so that areas of low heat transfer are present here.

DESCRIPTION OF PRIOR ART

The pressure loss over the length of the cooling channel is reduced by the technical developments known heretofore, by suitable arrangement of flow-conducting elements such as are apparent from FIG. 1.

An arrangement is known from U.S. Pat. No. 5,073,086 in which a flow guiding element is arranged in the cooling channel in the region of the deflection, and divides the cooling channel completely into an inner and an outer flow channel. The pressure loss brought about by the deflection can admittedly be reduced by this complete division of the flow; however, a clearly homogeneous removal of heat from the region of the deflection is not thereby attained. On the contrary, new areas of low heat transfer arise in the region of the flow guiding element constituted as a deflection guiding metal sheet.

The present invention has as its object to provide a component of a flow machine with improved cooling, by which the pressure loss is reduced in the region of the deflections of the cooling channel, and a homogeneous heat transfer is attained.

SUMMARY OF THE INVENTION

The object is attained with the component according to patent claim 1. Advantageous embodiments of the component are the subject of the dependent claims.

The proposed component of the flow machine, as a rule a turbine blade, has in a known manner a cooling channel through which cooling medium can flow, with at least one deflection formed by the wall of the cooling channel and deflecting the flow of the cooling medium from a first canal section into a downstream second channel section. In the region of this deflection, a flow guiding element, for example, in the form of a deflection guiding metal sheet, is arranged in the cooling channel in the present component, and divides the cooling channel completely into an inner and an outer flow channel in the deflection. The present component is distinguished in that the inner flow channel has a constriction in the flow cross section. By means of this constriction, i.e., a narrowing followed by a widening again of the flow cross section, a nozzle effect occurs in the inner flow channel and advantageously increases, and at the same time homogenizes, the heat transfer by means of the acceleration of the flow. The constriction is preferably formed by a suitable shaping or contouring of the flow guiding element and/or of the wall of the cooling channel in the region of the deflection.

By the proposed solution, a reduction of the pressure losses in the deflection is attained, with simultaneous homogenization of the heat transfer between the cooling medium and the wall material of the component. The present embodiment is independent of the further configuration of the component, and in particular independent of the rib configuration in the first and second channel sections, termed hereinafter the inlet channel and outlet channel, and also of possible roundings at the outer edge regions of the deflection. Such details, which occur in numerous gas turbine blades, have no influence on the advantageous effect of the present invention.

In a very advantageous further development of the component, one or more outlet bores for the cooling medium are additionally formed in the outer flow channel of the deflection, in the wall of the cooling channel for the cooling medium, via which bores a small portion of the cooling medium can emerge from the cooling channel. This so-called blowing out of cooling air—in the case of air as the cooling medium—again contributes, in connection with the already explained features, to a distinct improvement of the heat transfer, so that a component is obtained in which, on the one hand, local temperature peaks no longer occur in the region of the deflection, and on the other hand, high average values of the heat transfer to the cooling medium are attained. By the arrangement of these outlet bores in corner regions of the deflection, in which eddy areas otherwise occur, a clearly improved heat transfer is attained just there. The bores lead to breaking up the eddy areas and thus contribute to a homogenization of the heat transfer. Furthermore, these bores bring about the desired side effect that dust particles in the cooling medium are blown out through the bores. To amplify this side effect, the longitudinal axes of the bores are aligned about in the direction of the local flow lines of the flow of the cooling medium in the cooling channel.

Because of the small boundary flow speed, the additional bores provide only a small contribution to the global pressure loss over the cooling channel, hardly perceptible, however, due to the advantageous effect of the abovementioned features for minimizing the pressure loss.

The constriction of the flow cross section in the inner flow channel of the deflection, i.e., in the flow channel which has the shortest flow path in the deflection, which is required for the best possible functioning of the present invention, can be attained on the one hand by corresponding shaping of the flow guiding element, for example, by a thickening, and on the other hand by a corresponding shaping of the channel wall opposite the flow guiding element in the inner flow channel. The constriction can of course also be attained by a corresponding shaping of both elements, or of the further wall regions surrounding the inner flow channel.

In an advantageous embodiment, in which the first and second channel sections run approximately parallel on either side of a partition which forms a side of the wall of the cooling channel, the thickness of the partition increases in the region of the deflection, in order to bring about the corresponding constriction within the inner flow channel by means of this increase of thickness. Different shapes are possible for the contouring of this partition which separates the outlet channel from the inlet channel in order to bring about the said effect.

The flow guiding element which divides the cooling channel in the deflection into an inner and an outer flow channel is as a rule constituted as a flow guiding metal sheet. Preferably this flow guiding element extends a certain distance as far as into the second channel section or outlet channel. The distance by which the flow guiding element extends into the second channel section preferably corresponds to about the distance between the flow guiding element and the opposite wall of the cooling channel in the inner flow channel at the inlet or outlet of the deflection. An extension of the division of the cooling channel into an inner and an outer flow channel is attained by the extension of the flow guiding element. A slight constriction or widening of the channel cross section can be provided at the outlet of the inner flow channel, so that the wall of the flow guiding element in this region does not have to run unconditionally parallel to the channel wall of the second channel section or outlet channel.

The flow guiding element is preferably constituted and arranged within the deflection such that about 25–45% of the mass flow of the flow entering the deflection from the inlet channel enters in the region within the flow guiding element, i.e., in the inner flow channel, and the remainder flows outside the flow guiding element, i.e., in the outer flow channel. The mass flow ratio corresponds to the inlet cross section surface ratio of the outer and inner flow channels. The surface ratio at the outlet channel should about correspond to that of the inlet channel, i.e., it is not to deviate by more than 20% from this ratio. The deflection guiding metal sheet, as a rule of a round shape, can of course vary in thickness, or else even furthermore be provided with guiding devices.

In a further preferred variant of the invention, the flow guiding element has means which prevent a collection of dust or dirt in one of the flow channels. This can, for example, be attained in that the flow guiding element is equipped with passage apertures or otherwise configured in a suitable manner.

By the total of the measures or features set out in the developments, i.e., by the optimizing of the geometry and by the blowing out of cooling air at critical places, an optimized cooling is attained in the region of the deflecting element, with minimized pressure loss. The individual measures are here independent of the specific geometry of the components and of the cooling channel, and can, for example, also be replaced with cooling channel deflections whose deflection angle is not equal to 180°. Furthermore, the present invention is not limited to turbine blades nor to gas-cooled components, but can also be used, in particular, for components with other flowing cooling media.

BRIEF DESCRIPTION OF THE DRAWINGS

The present invention is again briefly explained hereinafter, without limitation of the general concept of the invention, using an embodiment example in connection with the accompanying drawings.

PREFERRED EMBODIMENTS OF THE INVENTION

Figure 1:
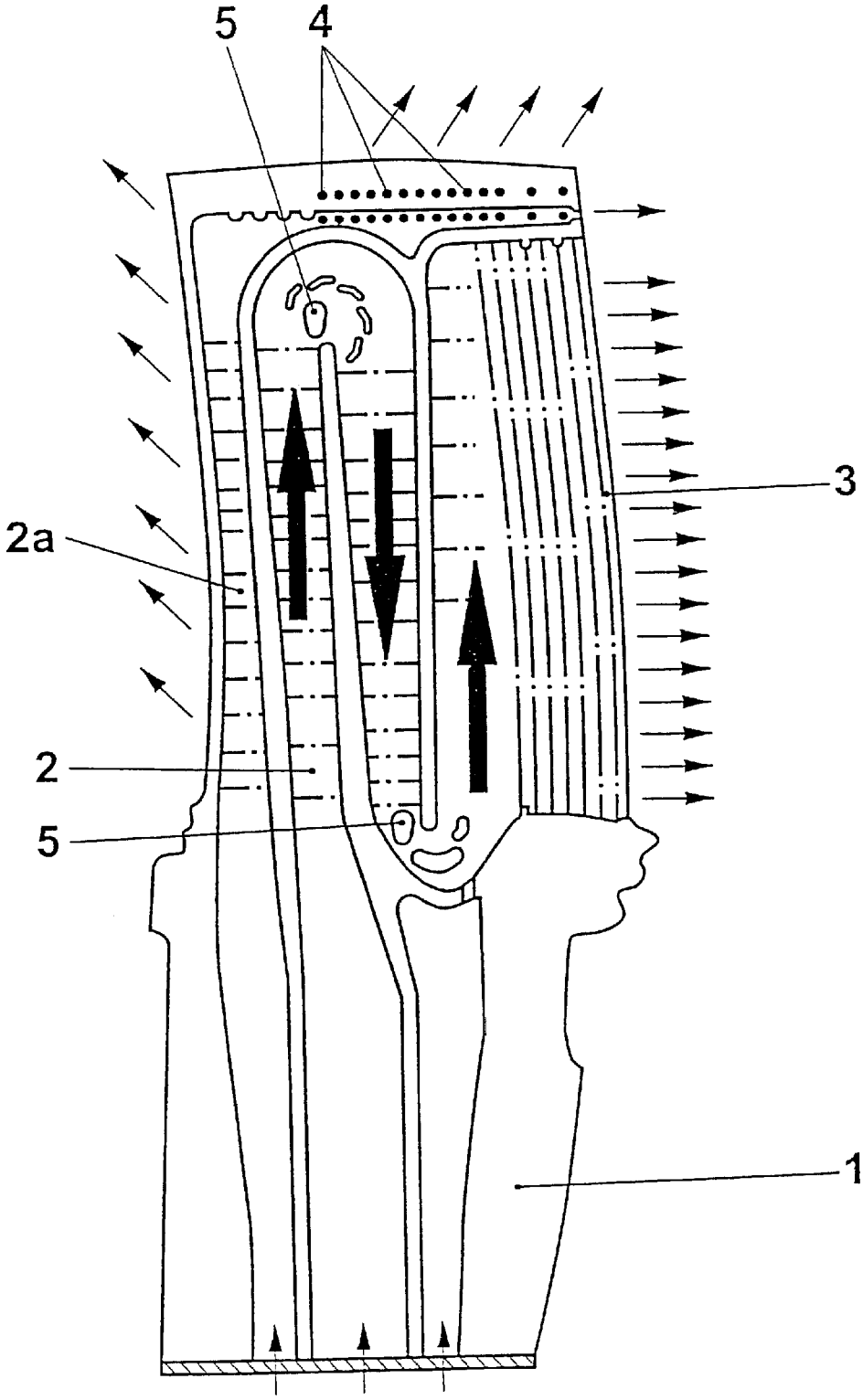
FIG. 1 PRIOR ART
FIG. 1 shows a section through a turbine blade with cooling channel deflections according to the prior art.
Figure 2:
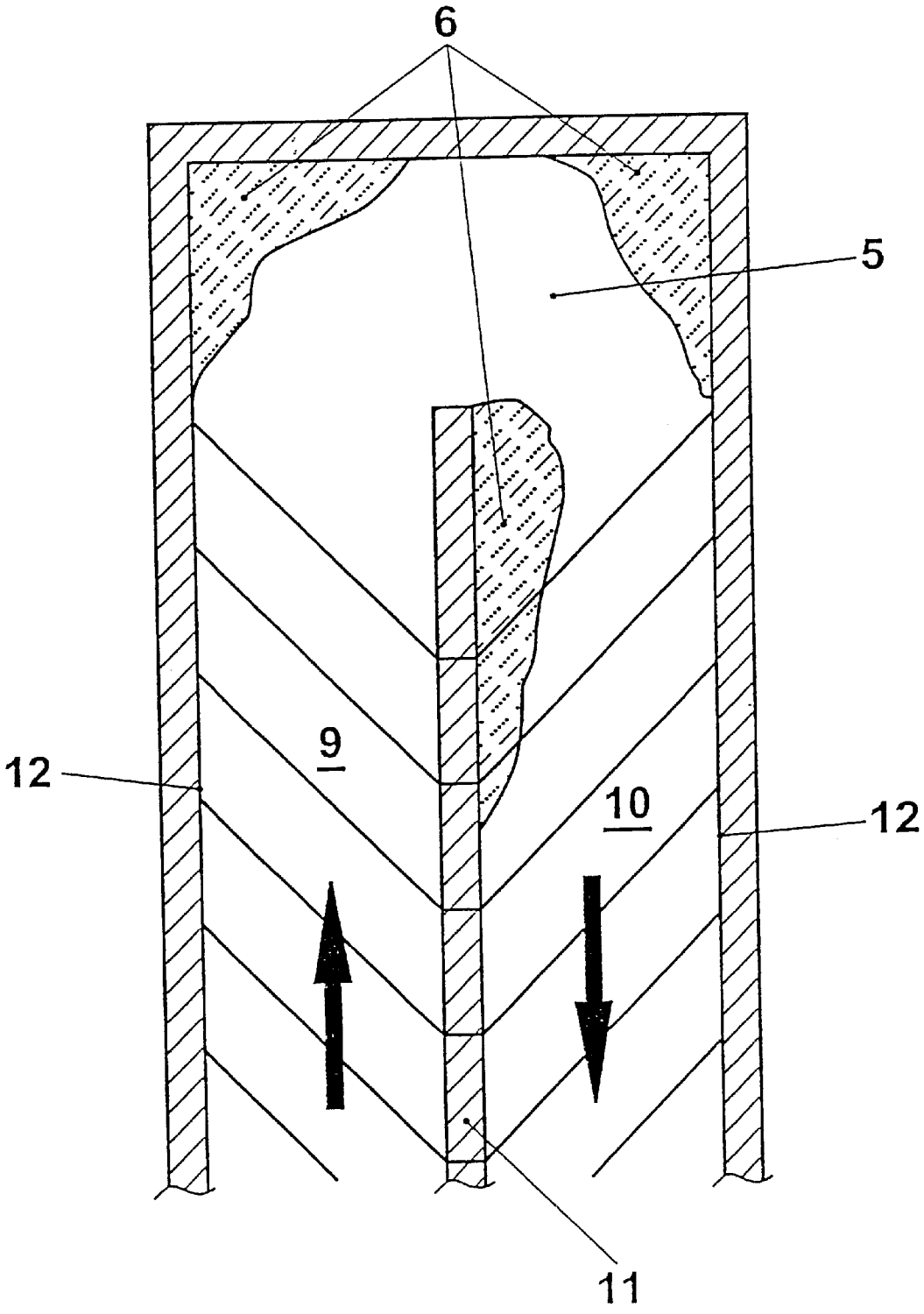
FIG. 2 PRIOR ART
FIG. 2 is a schematic diagram of the separation areas within a cooling channel deflection.

FIGS. 1 and 2 were already explained in connection with the description of the state of the art.

Figure 3:
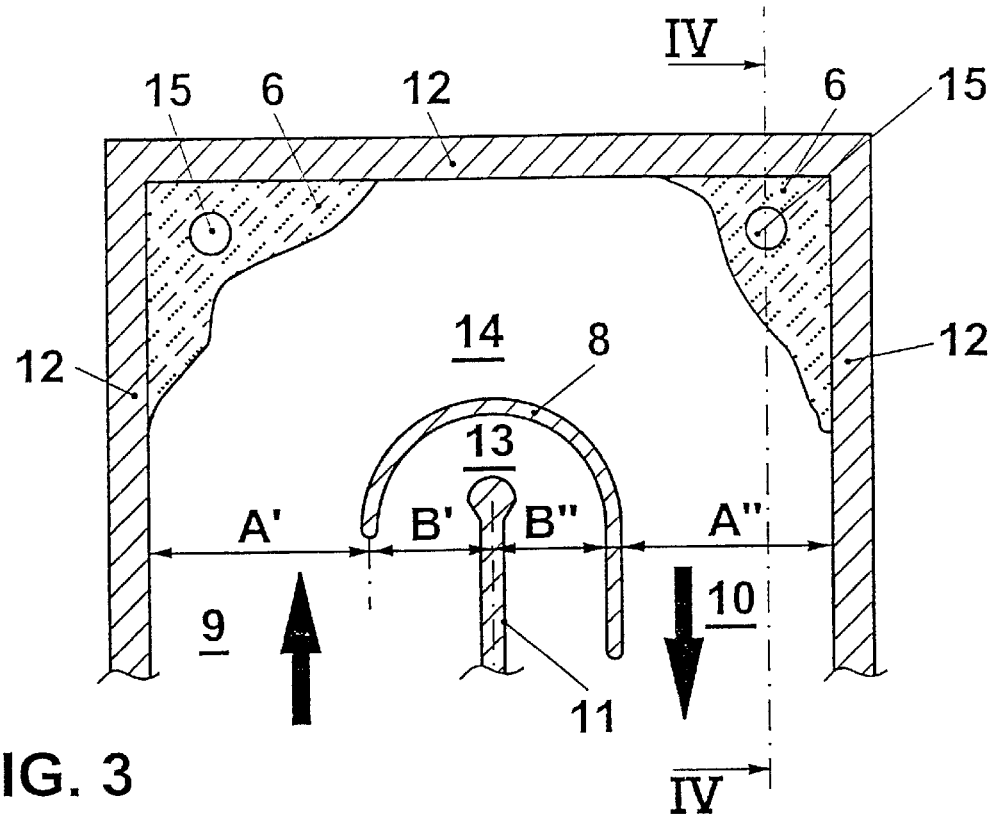
FIG. 3 schematically shows an embodiment example of the configuration of a cooling channel deflection according to the invention.

FIG. 3 schematically shows an embodiment example of the configuration of a cooling channel deflection 5 of the component of a flow machine according to the present invention. The flow direction of the cooling medium is again shown in this Figure by thick arrows. The cooling medium flows via a first channel section 9 into the deflection 5 and from there into a second channel section 10. The two channel sections 9 and 10 are separated from each other in this example by a partition 11 which is a component of the cooling channel wall 12. Such a cooling channel can be arranged in a conventional gas turbine blade, as is shown, for example, in FIG. 1.

A shaped flow-guiding or deflection guiding metal sheet 8 is formed within the deflection 5, and divides the cooling channel within the deflection 5 into a radially inner flow channel 13 and a radially outer flow channel 14. Both flow channels are completely separated from one another by the deflection guiding metal sheet 8. In the present example, the deflection guiding metal sheet 8 moreover extends into the second channel section 10. The extent over which the deflection guiding metal sheet 8 projects about corresponds to the width B' or B" of the distance between the partition 11 and the guiding metal sheet 8 at the outlet channel or the inlet channel.

The deflection guiding metal sheet is designed in this example such that about 25–45% of the mass flow of the flow entering the deflection 5 from the inlet channel 9 flows in the region of the inner flow channel 13 and the remainder in the region of the outer flow channel 14. The mass flow ratio corresponds here to the inlet surface ratio A'/B". The surface ratio A"/B" at the outlet channel corresponds in this example to the surface ratio at the inlet channel and is not to deviate by more than ±20% from A'/B'.

In the present example, the partition 11 is contoured in the region of the deflection 5, i.e., at its deflection-side end, such that it leads to a constriction of the flow cross section in the inner flow channel 13. The contouring is attained in this example by a greater thickness of the partition. A nozzle-like narrowing at the inlet to the inner flow channel 13, and a correspondingly shaped widening at the outlet into the second channel section 10, are attained by the linear increase of the thickness of the partition 11 shown in FIG. 4 and simultaneously at the deflection-side end or edge conformed to the rounded course of the deflection guiding metal sheet 8. A nozzle effect is brought about by this configuration and increases, and thereby simultaneously homogenizes, the heat transfer between the cooling medium and the component in this region by the acceleration of the flow. Without such a constriction, areas of low heat transfer would arise within the guiding metal sheet 8, i.e., in the inner flow channel 13. The constriction of the cross sectional surfaces of the inner flow channel 13 is to be about 5–20%.

In addition to the flow guiding metal sheet 8 and the constriction of the inner flow channel 13 brought about by the partition 11, two bores 15 are apparent in the present FIG. 3 in the corner regions of the deflection 5. A small portion of the cooling air is blown out through these additional bores 15 into the external flow outside the component. This leads in an advantageous manner to an acceleration of the flow in the region of the separation or eddy areas at the outer corners, and forces a convective flow of cooling medium through the eddy areas 6, so that the eddy areas fill up, which contributes to a further homogenizing of the heat transfer.

The bores 15 are preferably aligned, according to the local position, with their bore axes approximately in the direction of the streamlines of the flow of the cooling medium, so that—as an additional side effect—the discharge of small particles or dust in the cooling air can take place via the bores 15.

Figure 4:
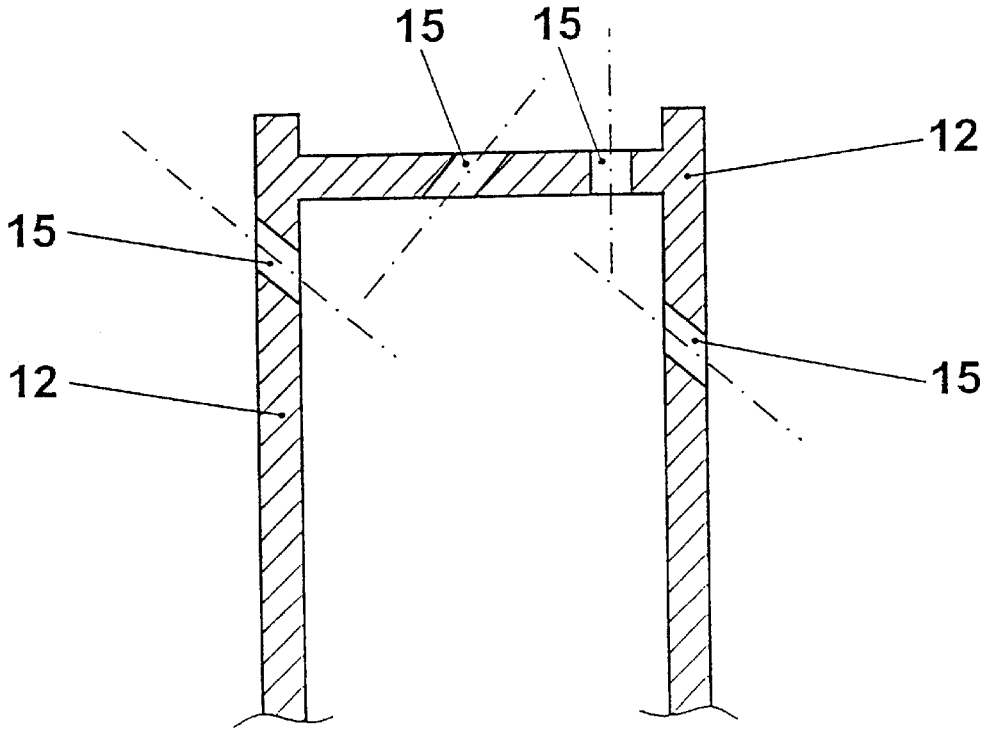
FIG. 4 shows an example of an arrangement of additional outlet bores in the cooling channel deflection.

FIG. 4 shows in this regard a possible arrangement of the bores 15 and also a favorable orientation of the associated bore axes (indicated by dash-dot lines). The diagram corresponds to a section through a gas turbine blade tip, perpendicular to the observation plane of FIG. 3.

Figure 5:
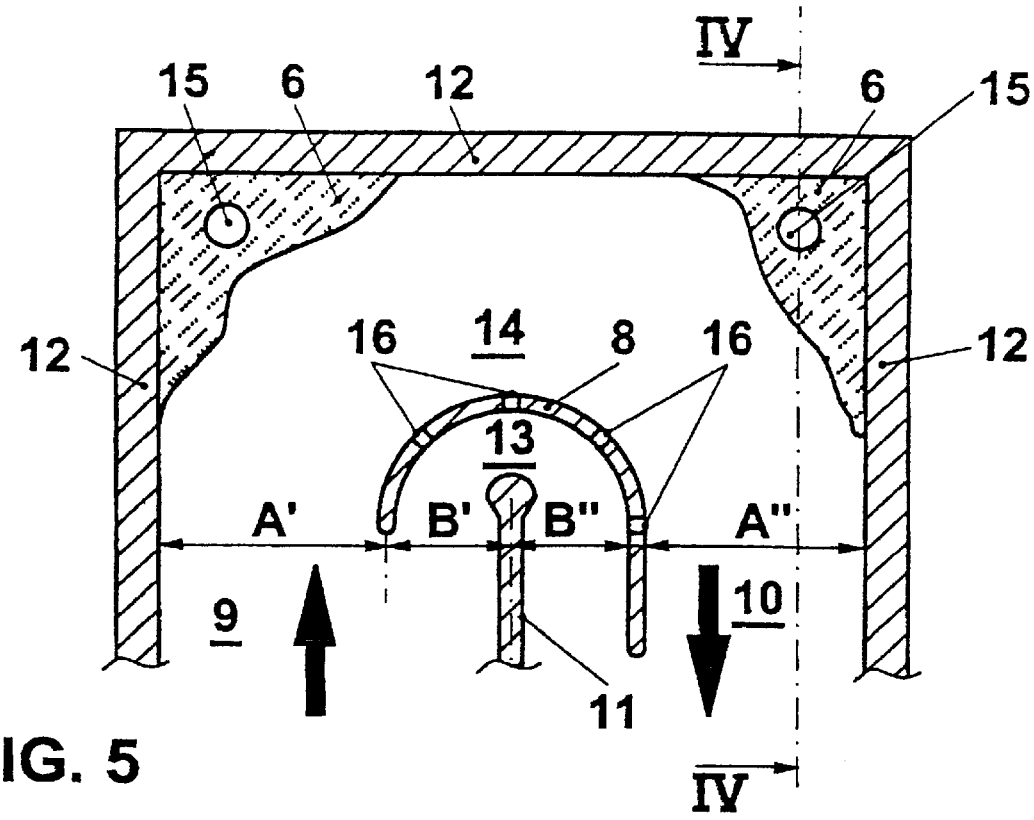
FIG. 5 shows the configuration shown in FIG. 3, with measures for avoiding one-sided dust and dirt accumulations.
Figure 6:
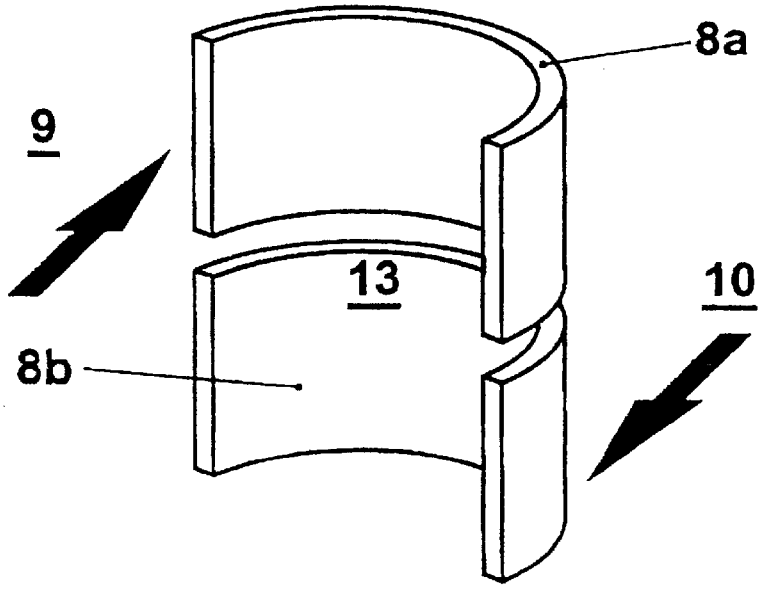
FIG. 6 shows a configuration of the flow guiding element for avoiding one-sided dust and dirt accumulations.

FIG. 5 shows a further preferred configuration of the invention shown in FIG. 3. The flow guiding element 8 has a number of bores 16 which contribute to avoiding dust and dirt collections in the outer 14 or inner 13 flow channel. FIG. 6 shows a further possibility of attaining this effect. The flow element is divided there into several partial elements, 8*a* and 8*b*, between which a gap is formed which has the same effect as the bores 16 in FIG. 5.

LIST OF REFERENCE NUMERALS

1 blade foot
2, 2*a* a cooling channel
3, outlet slit, rear edge blowing out
4, outlet apertures
5 deflection
6 eddy area or recirculation area, area with high pressure loss
8 flow guiding element, flow or deflection guiding metal sheet
8*a*, 8*b* partial elements
9 first, upstream, channel section
10 second, downstream, channel section
11 partition
12 cooling channel wall
13 inner flow channel
14 outer flow channel
15 outlet bores
16 bore, throughflow aperture

What is claimed is:

1. A component of a flow machine, comprising:

a cooling channel through which cooling medium can flow, said cooling channel having a wall and at least one deflection being formed by the wall of the cooling channel;

said cooling channel having a first channel section and a downstream second channel section, and the flow of the cooling medium being deflected from the first channel section into the downstream second channel section by the at least one deflection;

at least one flow guiding element being arranged in the cooling channel in the region of the deflection, the at least one flow guiding element dividing the cooling channel in the deflection into an inner and an outer flow channel, at least one outlet bore being formed in the outer flow channel in the wall of the cooling channel and arranged in the corner regions of the deflection, and a small portion of the cooling medium can emerge from the cooling channel through the at least one outlet bore; and the inner flow channel having a constriction in a flow cross section of the inner flow channel.

2. The component according to claim 1, wherein the constriction is formed by at least one of the shaping or contouring of the at least one flow guiding element and the wall of the cooling channel.

3. The component according to claim 2, wherein the first and second channel sections respectively are formed on either side of a partition that is formed as a portion of the wall of the cooling channel, the thickness of the partition increasing in the region of the deflection, thereby forming the constriction of the flow cross section in the inner flow channel.

4. The component according to claim 1, wherein the at least one flow guiding element extends into the second channel section.

5. The component according to claim 4, wherein the at least one flow guiding element extends over a distance into the second channel section, said distance being approximately equal to the distance between the at least one flow guiding element and the wall of the cooling channel opposite from the at least one flow guiding element in the inner flow channel at the transition of the first or second channel section to the deflection.

6. The component according to claim 1, wherein the at least one flow guiding element is arranged in the cooling channel such that about 25–45% of the mass flow of cooling medium arriving via the first channel section flows through the inner flow channel.

7. The component according to claim 1, wherein at least one of the at least one flow guiding element and the wall of the cooling channel are made to constrict the flow cross section in the inner flow channel by about 5–20%.

8. The component according to claim 1, wherein the at least one outlet bore extends at least approximately in the direction of local flow lines of the cooling medium.

9. The component according to claim 1, wherein the at least one outlet bore is dimensioned to enable a dust discharge therethrough from the cooling medium.

10. The component according to claim 1, wherein the at least one outlet bore is arranged in low throughflow eddy areas of the cooling channel, and the at least one outlet bore ensures the maintenance of a convective cooling medium throughflow in the low throughflow eddy areas.

11. The component according to claim 1, wherein the at least one flow guiding element has a suitable configuration to prevent dust collection on one side of the at least one flow guiding element.

* * * * *

UNITED STATES PATENT AND TRADEMARK OFFICE

CERTIFICATE OF CORRECTION

PATENT NO. : 6,595,750 B2
DATED : July 22, 2003
INVENTOR(S) : Sacha Parneix et al.

It is certified that error appears in the above-identified patent and that said Letters Patent is hereby corrected as shown below:

Title page,
Item [73], should read:
-- [73] Assignee: ALSTOM (Switzerland) Ltd, Baden (CH) --

Signed and Sealed this

Twenty-eighth Day of October, 2003

JAMES E. ROGAN
*Director of the United States Patent and Trademark Office*